US010405589B1

(12) United States Patent
Womack

(10) Patent No.: US 10,405,589 B1
(45) Date of Patent: Sep. 10, 2019

(54) SUPPORT GARMENT FOR RESISTANCE EXERCISE

(71) Applicant: Michael Womack, Princeton, TX (US)

(72) Inventor: Michael Womack, Princeton, TX (US)

( * ) Notice: Subject to any disclaimer, the term of this patent is extended or adjusted under 35 U.S.C. 154(b) by 861 days.

(21) Appl. No.: 14/555,427

(22) Filed: Nov. 26, 2014

(51) Int. Cl.
*A41D 13/00* (2006.01)
*A41D 13/05* (2006.01)

(52) U.S. Cl.
CPC ..... *A41D 13/0512* (2013.01); *A41D 13/0015* (2013.01)

(58) Field of Classification Search
CPC ..... A41D 12/0512; A41D 12/0015; A41D 12/008
See application file for complete search history.

(56) References Cited

U.S. PATENT DOCUMENTS 6,231,488 B1 * 5/2001 Dicker ..... A41D 13/0015 2/69
8,771,155 B1 * 7/2014 Bell ..... A63B 69/0059 482/124

* cited by examiner

*Primary Examiner* — Richale L Quinn
(74) *Attorney, Agent, or Firm* — Michael Diaz

(57) ABSTRACT

A support garment for use during resistance training. The support garment includes an elastic frontal portion. In addition, the support garment includes two upper arm sleeves located on opposite sides of the elastic frontal portion. Each upper arm sleeve is configured for wear on an upper arm of a user above the elbows of the user. The user positions one arm in each upper arm sleeve and positions the elastic frontal portion across a chest of the user during resistance training. Additionally, the upper arm sleeves are biased inwardly by the elastic frontal portion to provide support during a resistance exercise.

16 Claims, 14 Drawing Sheets

SUPPORT GARMENT FOR RESISTANCE EXERCISE

BACKGROUND OF THE INVENTION

Field of the Invention

This invention relates to clothing. Specifically, and not by way of limitation, the present invention relates to a garment for use in assisting during resistance training, such as weight training.

Description of the Related Art

Resistance training, such as weight training or weight lifting is an excellent form of exercise, sport, and form of rehabilitation for injured patients. However, with the use of weights or other resistance devices, there is an inherent risk to damaging a person's shoulders during various resistance exercises. In one example, in the sport of weight lifting, a popular event is bench pressing where an individual attempts to bench press a maximum weight. Unfortunately, the geometry of the movement of the heavy weight places an extreme stress on the individual's shoulders. To assist in the reduction of this stress, many participants in this event utilize support garments providing a tight fit over the entire upper torso of the individual, thereby reducing some of the stress on the shoulders. These shirt garments are typically constructed of a heavy elastic material and fit very tightly around the individual. It is often very difficult to remove and put on these shirt garments. Additionally, although these existing garments assist in supporting the individual during the lift, even more support is needed to further reduce the stress to the individual to avoid injury during the bench press event.

Although there are no known prior art teachings of a garment such as that disclosed herein, a prior art reference that discusses subject matter that bears some relation to matters discussed herein is U.S. Pat. No. 8,771,155 to Bell (Bell). Bell discloses an exercise apparatus having two arm cuffs and a central rectangular-shaped piece of material connecting the two arm cuffs. The cuffs are sized and shaped to fit over the arms and cover the elbows of the user. Although the Bell apparatus does provide some support to the user during resistance exercise. Bell suffers from several disadvantages. The apparatus provides limited support to the user as support is merely providing at a region of the person's elbows and the areas adjacent to the elbows. Furthermore, the apparatus cannot be worn under a shirt and most be worn outside of any other clothing, thereby negating the use of the apparatus during a competition.

It would be advantageous to have a garment which provides greater support to an individual during various weight resistance exercises which may be worn by the user without restriction. It is an object of the present invention to provide such a garment.

SUMMARY OF THE INVENTION

In one aspect, the present invention is directed to a support garment for use during resistance training. The support garment includes an elastic frontal portion. In addition, the support garment includes two upper arm sleeves located on opposite sides of the elastic frontal portion. Each upper arm sleeve is configured for wear on an upper arm of a user above the elbows of the user. The user positions one arm in each upper arm sleeve and positions the elastic frontal portion across a chest of the user during resistance training. Additionally, the upper arm sleeves are biased inwardly by the elastic frontal portion to provide support during a resistance exercise.

In another aspect, the present invention is directed to a support garment and bib combination for use during resistance training. The support garment includes an elastic frontal portion. In addition, the support garment includes two upper arm sleeves located on opposite sides of the elastic frontal portion. Each upper arm sleeve is configured for wear on an upper arm of a user above the elbows of the user. In addition the combination includes a bib section extending from a lower border of the support garment. The user positions one arm in each upper arm sleeve and positions the elastic frontal portion across a chest of the user during resistance training. Additionally, the upper arm sleeves are biased inwardly by the elastic frontal portion to provide support during a resistance exercise.

In still another aspect, the present invention is directed to a support band for use during resistance training. The support band includes an elastic band and an elastic frontal portion formed by affixing a portion of the band together. The elastic band is configured with a first opening located on a first side of the frontal portion and a second opening located on a second side opposite of the first side of the elastic frontal portion. Each opening sized and shaped to accommodate an upper arm of a user above an elbow of the user. The user positions one arm in each opening and positions the elastic frontal portion across a chest of the user during resistance training.

DESCRIPTION OF THE INVENTION

Figure 1:
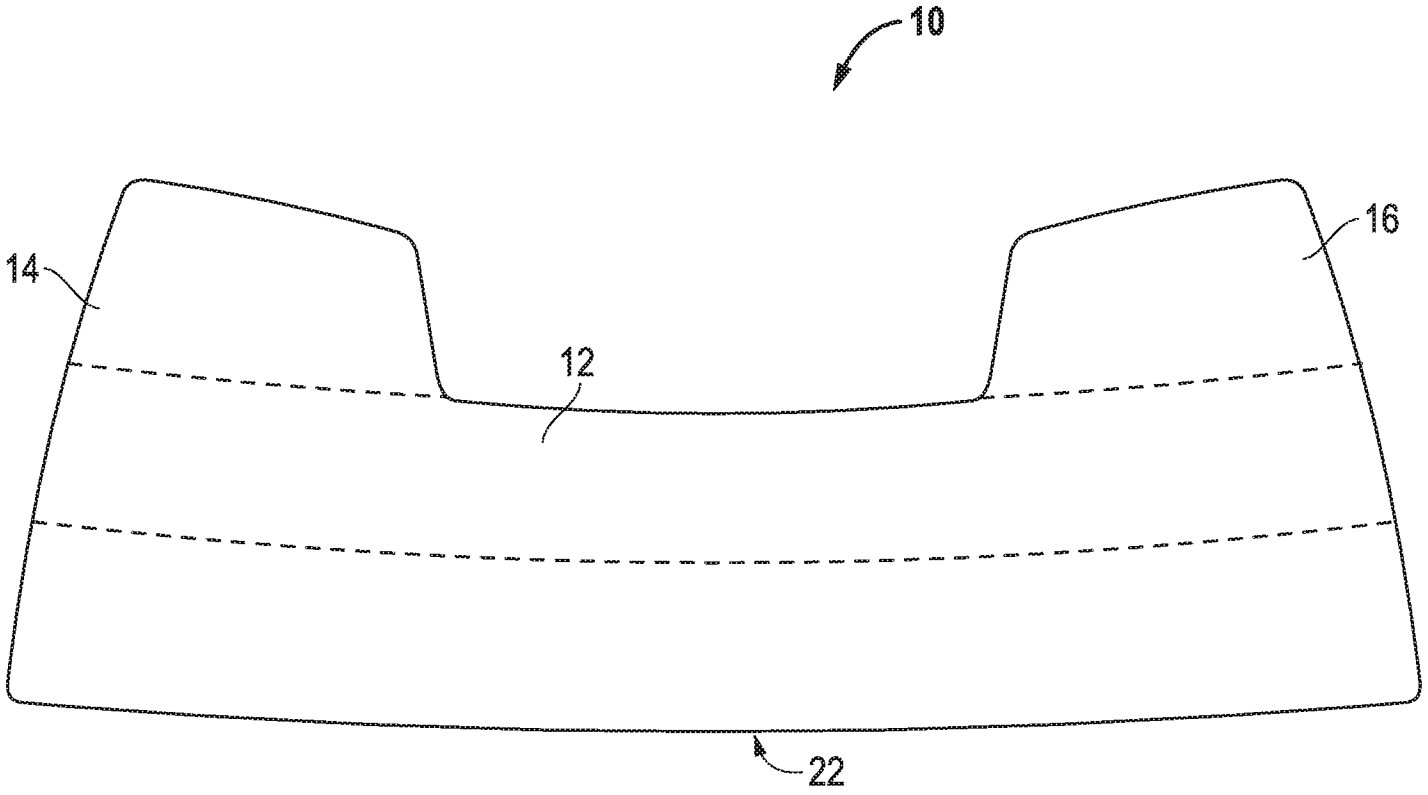
FIG. 1 is a top view of a support garment in one embodiment of the present invention.
Figure 2:
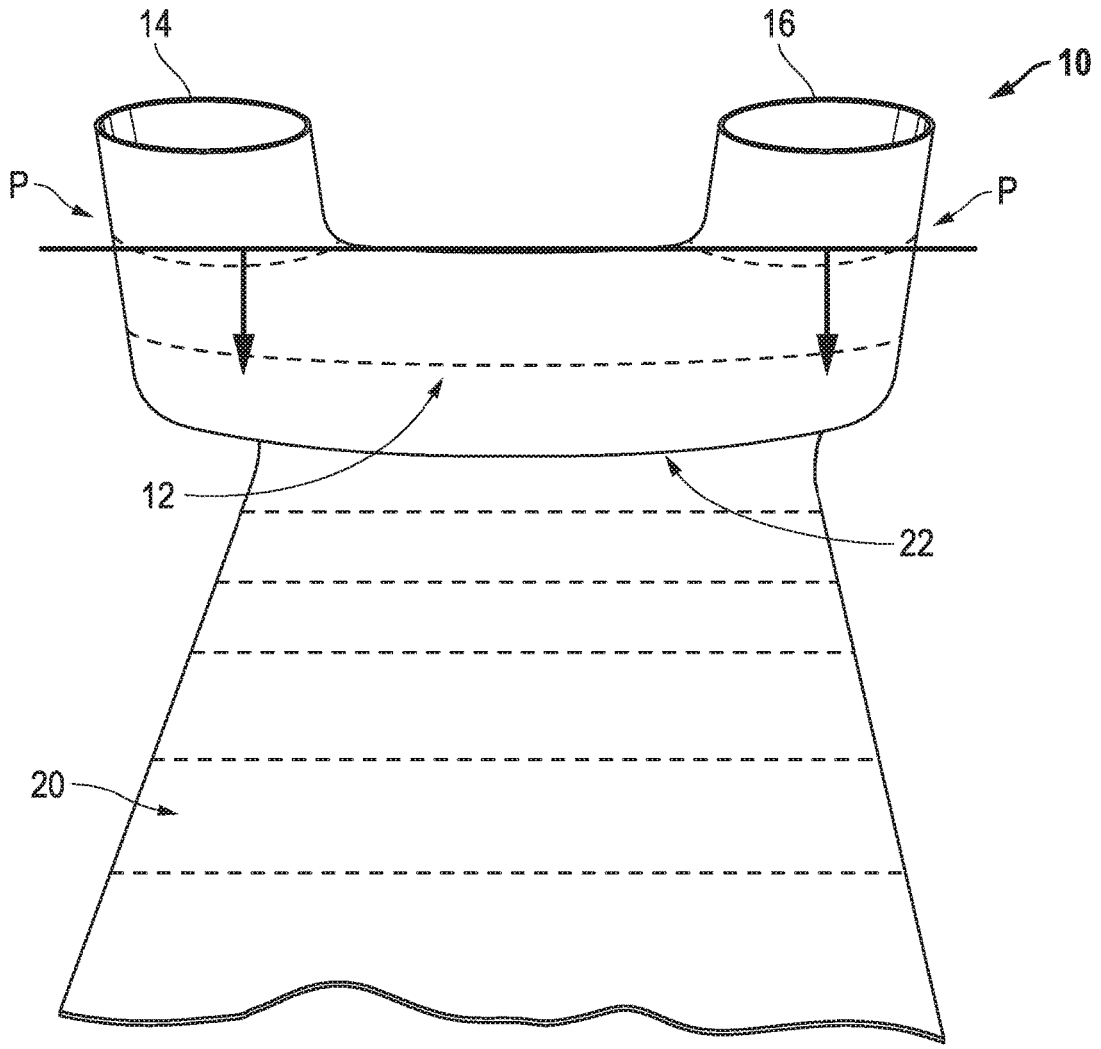
FIG. 2 is a bottom view of the support garment attached to a bib section in another embodiment of the present invention.

The present invention is a garment providing support during weight resistance events. FIG. 1 is a top view of a support garment 10 in one embodiment of the present invention. The support garment includes a frontal portion 12 running between two upper arm sleeves 14 and 16. The support garment may be used as shown in FIG. 1 or may be incorporated in a bib configuration as shown in FIG. 2. FIG. 2 is a bottom view of the support garment attached to a bib section 20 in another embodiment of the present invention. As shown in FIG. 2, the bib section is affixed to a lower border 22 of the support garment and preferably extends to cover the exposed portion of the torso of the user.

Figure 3:
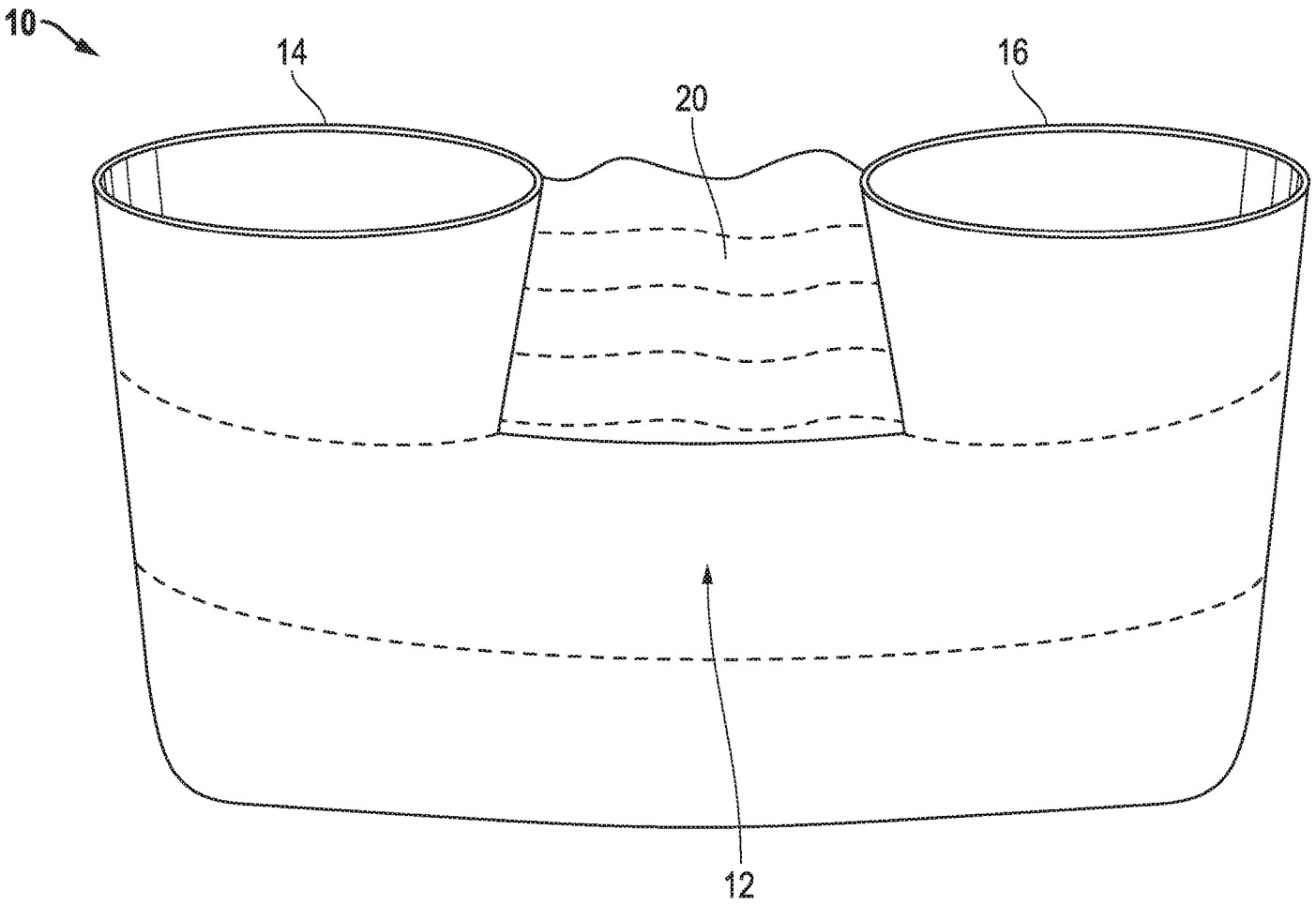
FIG. 3 is a top view of the support garment and bib section of FIG. 2.

FIG. 3 is a top view of the support garment 10 and bib section 20 of FIG. 2. The upper arm sleeves 14 and 16 each are sized and shaped to fit around the appropriate upper arm of a user with each sleeve sized to fit above each elbow of the user. In addition, the sleeve is configured in the shape of a short sleeve of a shirt. The frontal portion 12 extends frontally outward from the user. Referencing FIG. 2, the frontal portion 12 extends out from a planar region of the bib section 20. By extending the frontal portion outward, there is an inner space (not shown in FIGS. 1-3) between the front portion and a user's chest when the support garment 10 is worn by the user with the arms extended and conforms against the chest of the user when the user's arms are bent (e.g., when lowering a weight bar towards the chest). The frontal portion surrounds and is attached to the upper arm sleeves 14 and 16 at a lower perimeter P. The frontal portion is positioned below the lower perimeter P of both upper arm sleeves 14 and 16.

Figure 4:
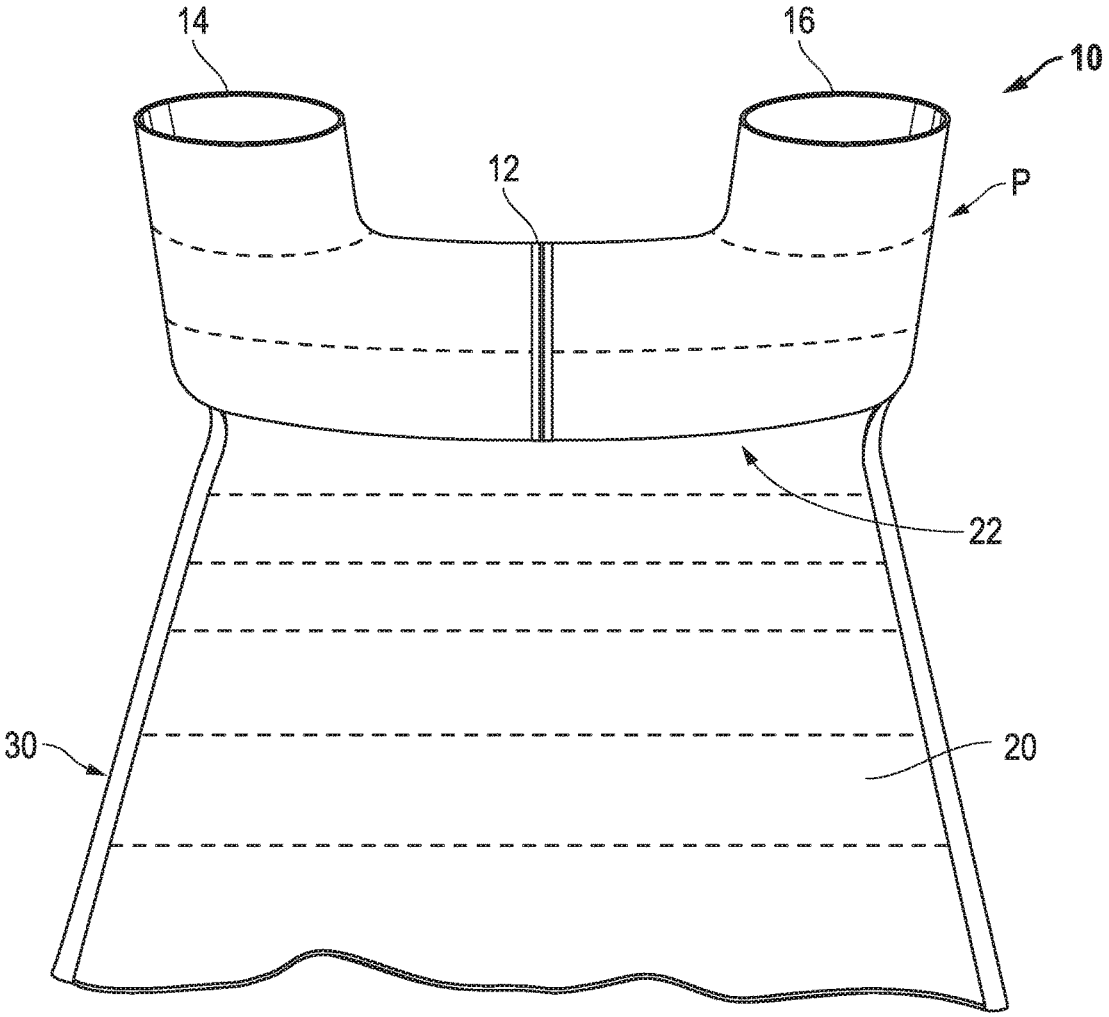
FIG. 4 is a plan view of the support garment and the bib section of FIG. 2.
Figure 5:
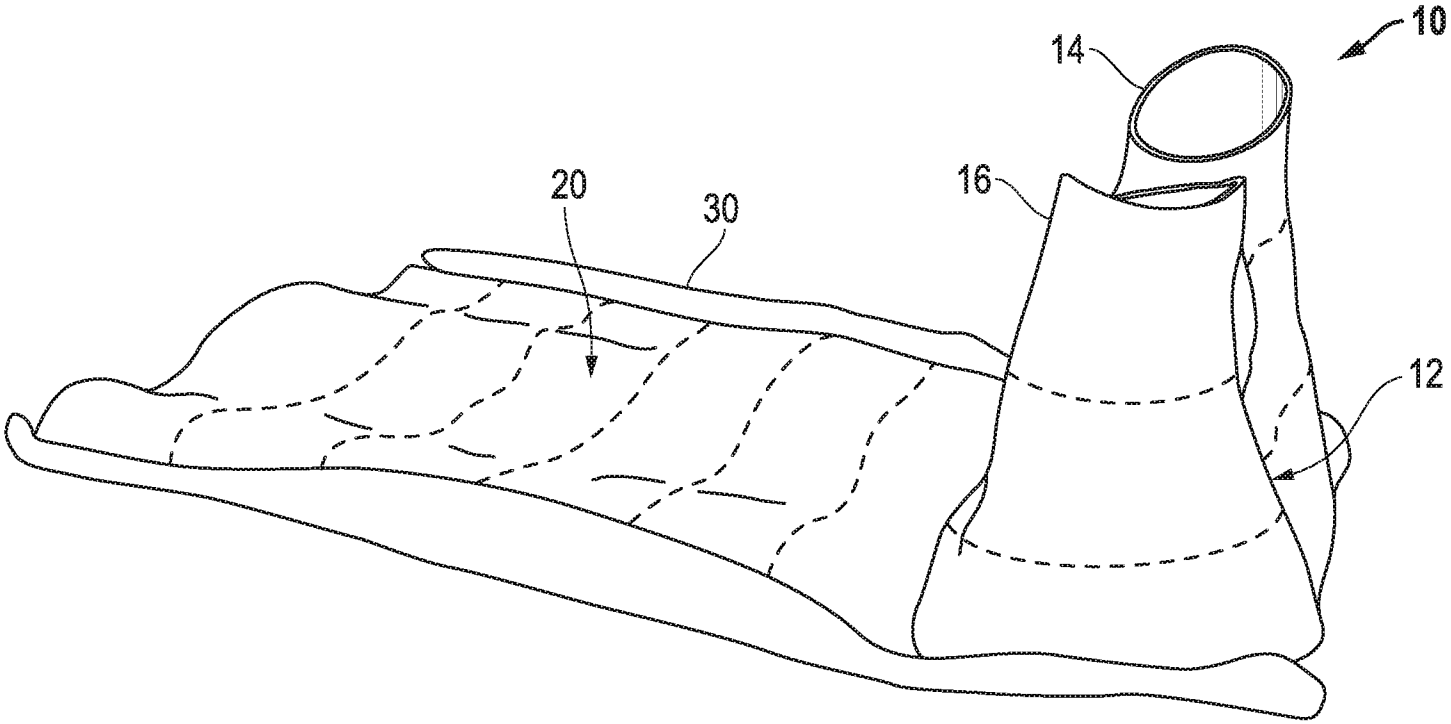
FIG. 5 is a side view of the support garment and the bib section of FIG. 2.

FIG. 4 is a plan view of the support garment 10 and the bib section 22 of FIG. 2. FIG. 5 is a side view of the support garment 10 and the bib section 22 of FIG. 2. The support garment and bib section may be constructed of a strong elastic material. In one embodiment, the elastic material is constructed from a material consisting of 70 percent elasticity and 30 percent cotton. However, the present invention may be constructed of an elastic material allowing support to the user of the support garment during resistance training. In another embodiment, the bib section and support garment may be affixed to a rear portion 30. The rear portion in combination with the bib section 20 and the support garment may be configured as a shirt. As depicted in FIG. 4, the rear portion is located underneath the bib section 20. The rear portion is sized and shaped to fit over the back of a user. The rear portion may be made of any material and does not have to be made of a strong elastic material.

Figure 6:
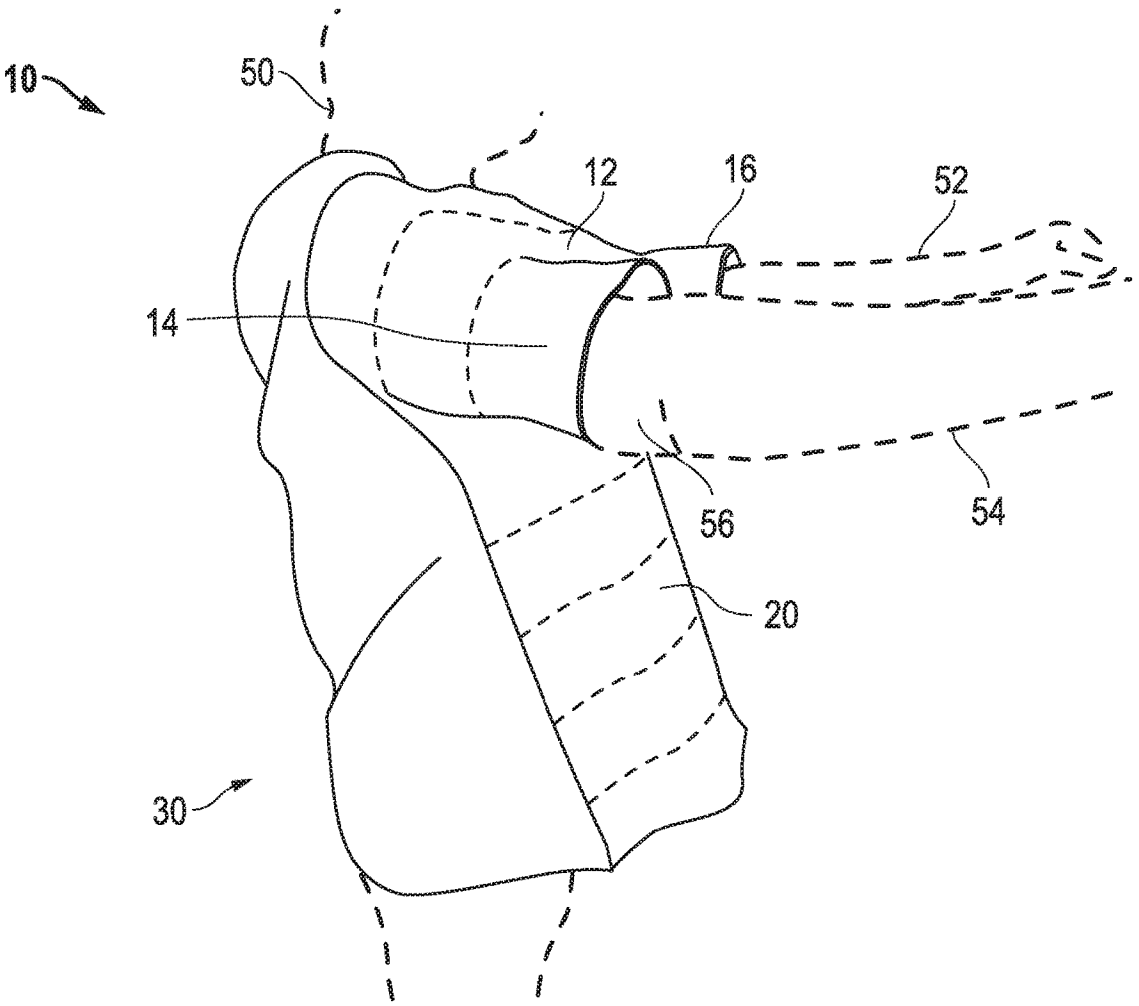
FIG. 6 is a right side view of the support garment, the bib section, and the rear portion in the shirt configuration worn by a user.
Figure 7:
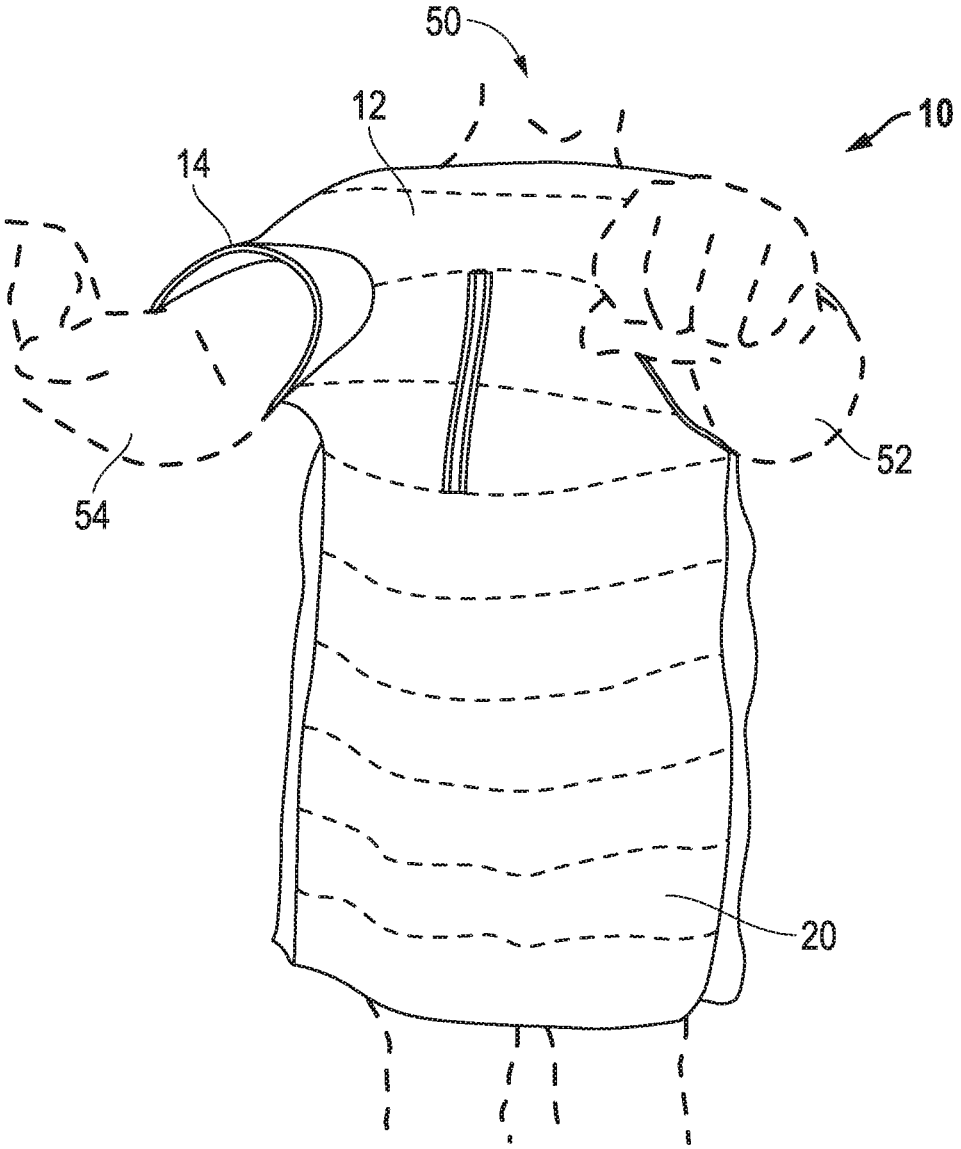
FIG. 7 is a front view of the support garment of FIG. 6.
Figure 8:
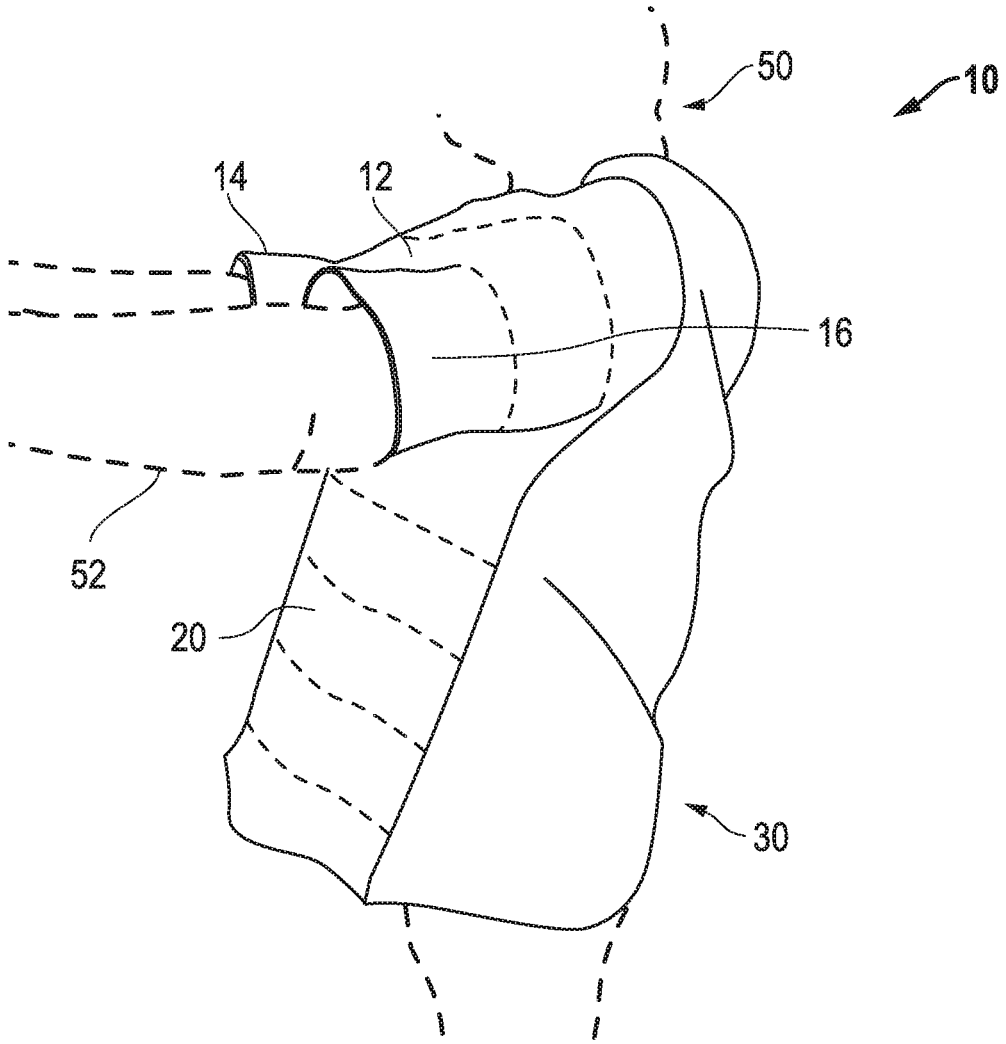
FIG. 8 is a left side view of the support garment of FIG. 6.

FIG. 6 is a right side view of the support garment 10, the bib section 22, and the rear portion 30 in the shirt configuration worn by a user 50. FIG. 7 is a front view of the support garment 10 of FIG. 6. FIG. 8 is a left side view of the support garment 10 of FIG. 6. As depicted, the user's arms 52 and 54 are positioned through the upper arm sleeves 14 and 16. The sleeves 14 and 16 are sized to fit above the elbows 56 of the user. The rear portion covers 30 covers the back of the user and the support garment 10, the bib section 22 and the rear portion 30 form a shirt configuration.

Figure 9:
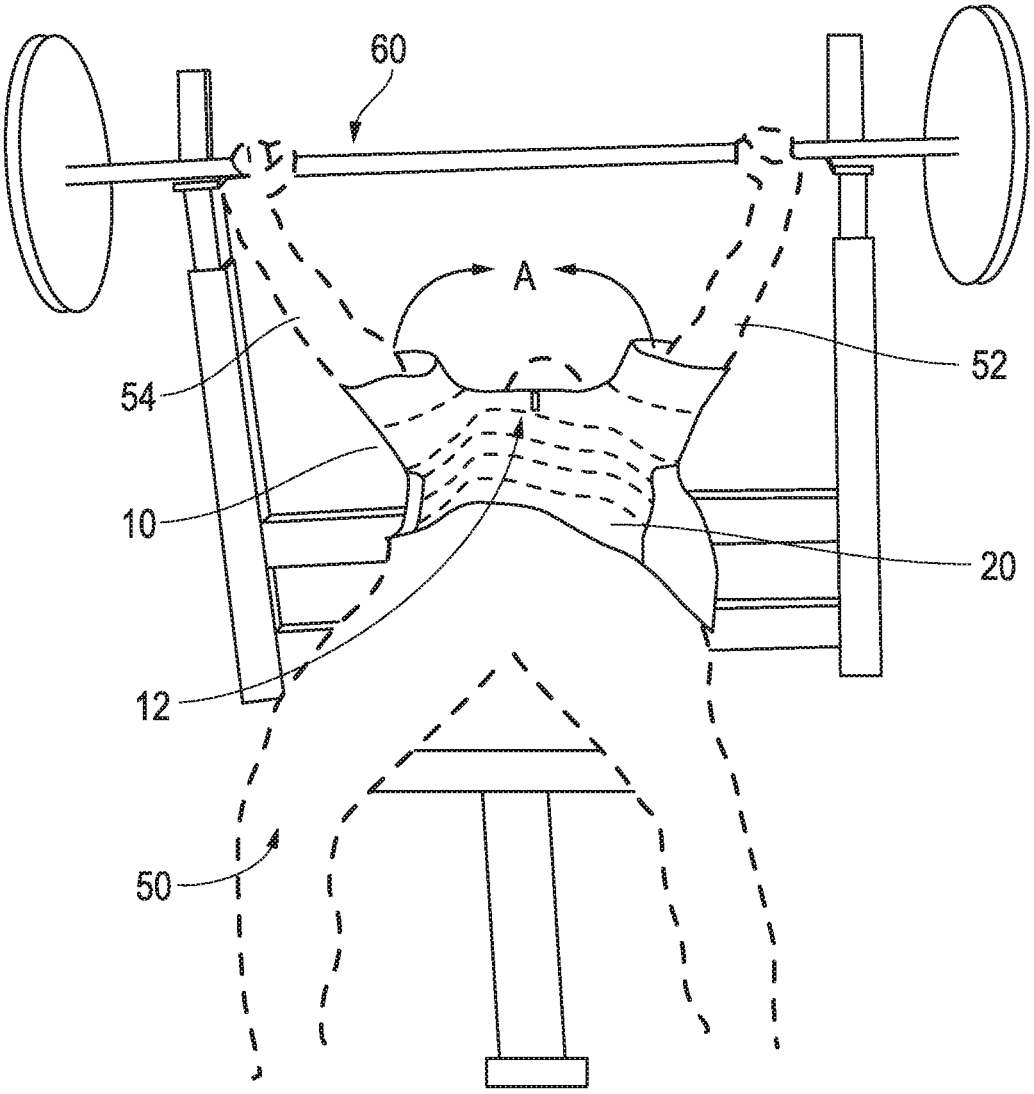
FIG. 9 is a side view of the support garment in the shirt section worn by the user in an extended position.

FIG. 9 is a side view of the support garment 10 in the shirt section worn by the user in an extended position. In this position, the arms 52 and 54 of the user 50 are extended with a weight bar 60 upraised. The frontal portion 12, as well as the upper arm sleeve 14 and 16, is biased (seen as A in FIG. 9) in a contracted inward position, which results in providing support to an extended position.

Figure 10:
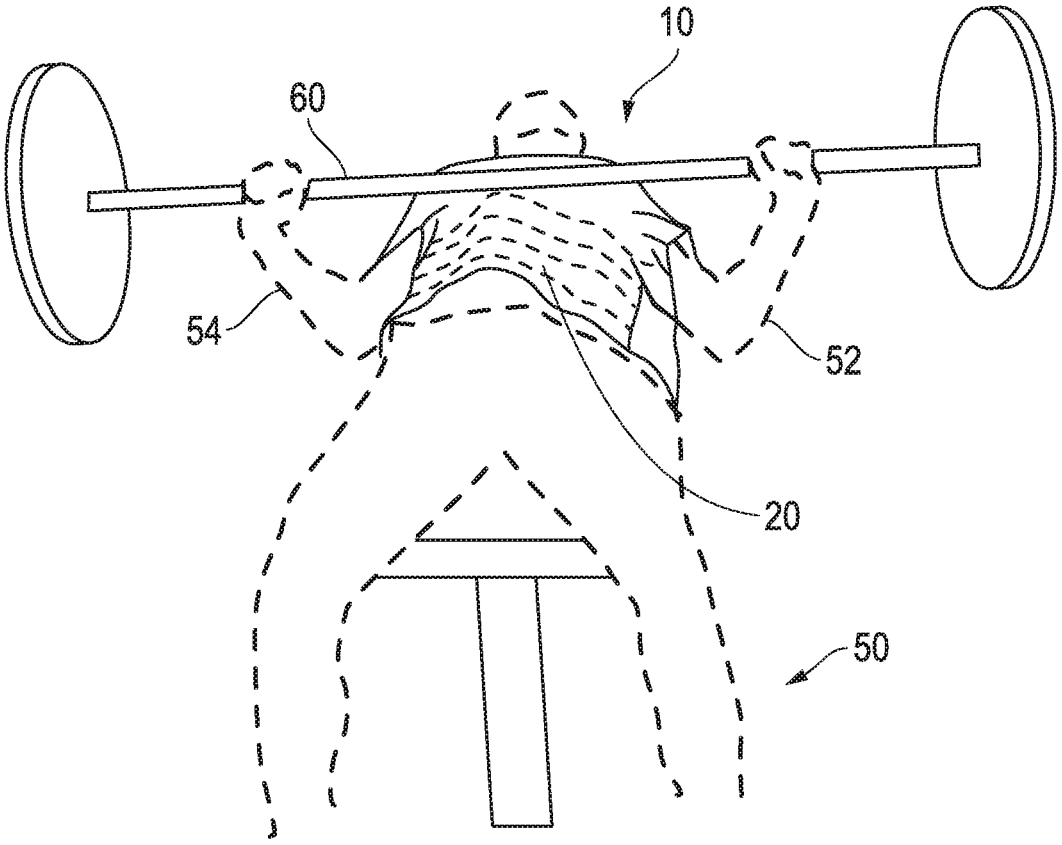
FIG. 10 is a side view of the support garment in the shirt configuration with the user in a contracted position.

FIG. 10 is a side view of the support garment 10 in the shirt configuration with the user in a contracted position. The user has his arms contracted to allow the bar 60 to be lowered against the chest of the user. Since the support garment provides an inward bias, as the user lowers the bar, the support garment provides a force or support of the weight bar 60. As the user again raises the bar, the bias assists the user in raising the bar.

With reference to FIGS. 1-10, the operation of the support garment will now be explained. The user positions his arms 52 and 54 through the upper arm sleeves 14 and 16 with the frontal portion 12 against the chest of the user. In the shirt configuration, the rear portion 30 is positioned against the back of the user. The support garment 10 is constructed in such a fashion that the arm sleeves 14 and 16 are biased inwardly. Thus, with the users arms positioned through the arm sleeves 14 and 16, the arms of the user are pushed inward by the bias A, assisting in supporting the arms in the extended position. As the user contracts his arms and lowers the weight toward his chest, the support garment provides support as a weight is lowered.

Figure 11:
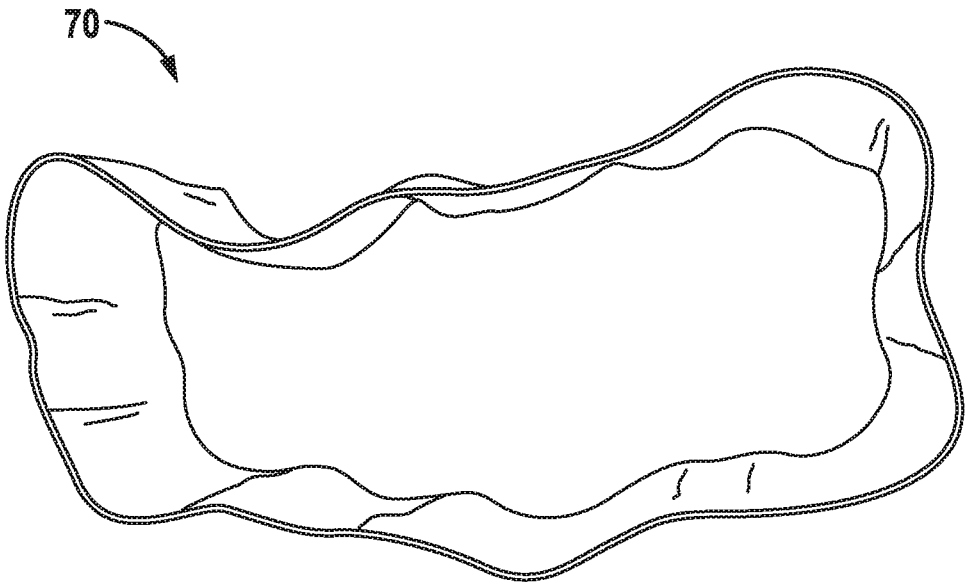
FIG. 11 is a top view of a support band in another embodiment of the present invention.
Figure 12:
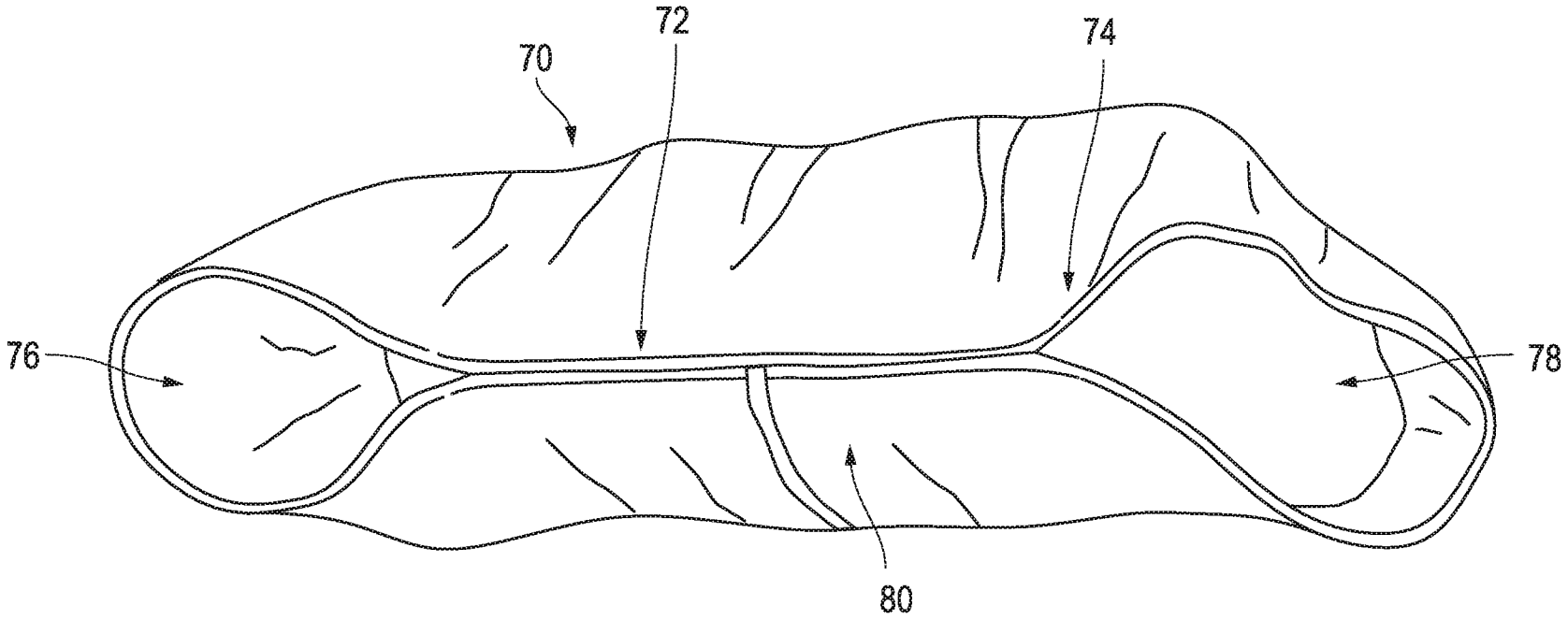
FIG. 12 is a top view of the band sown at a seam.
Figure 13:
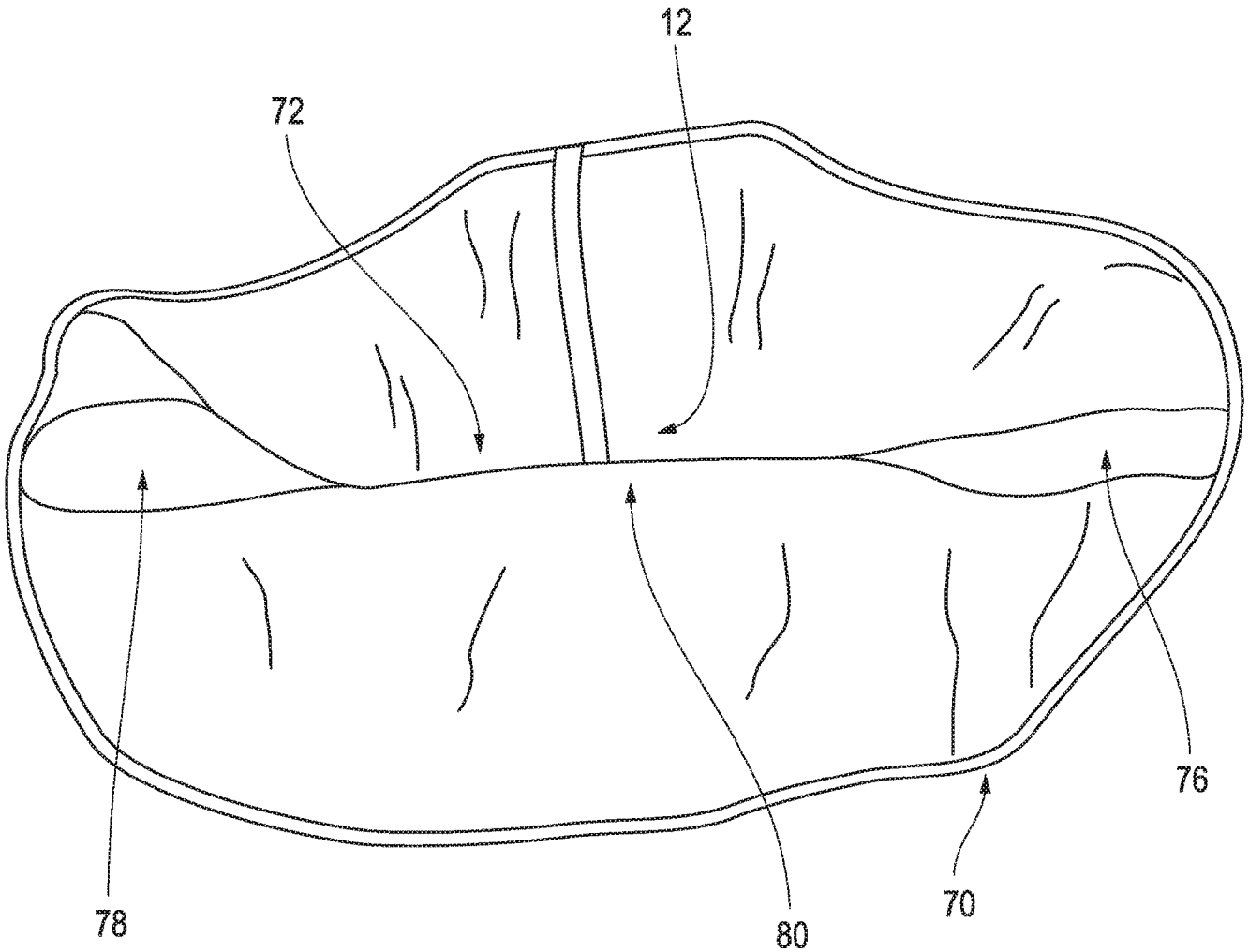
FIG. 13 is a bottom view of the band of FIG. 12 with the seam.
Figure 14:
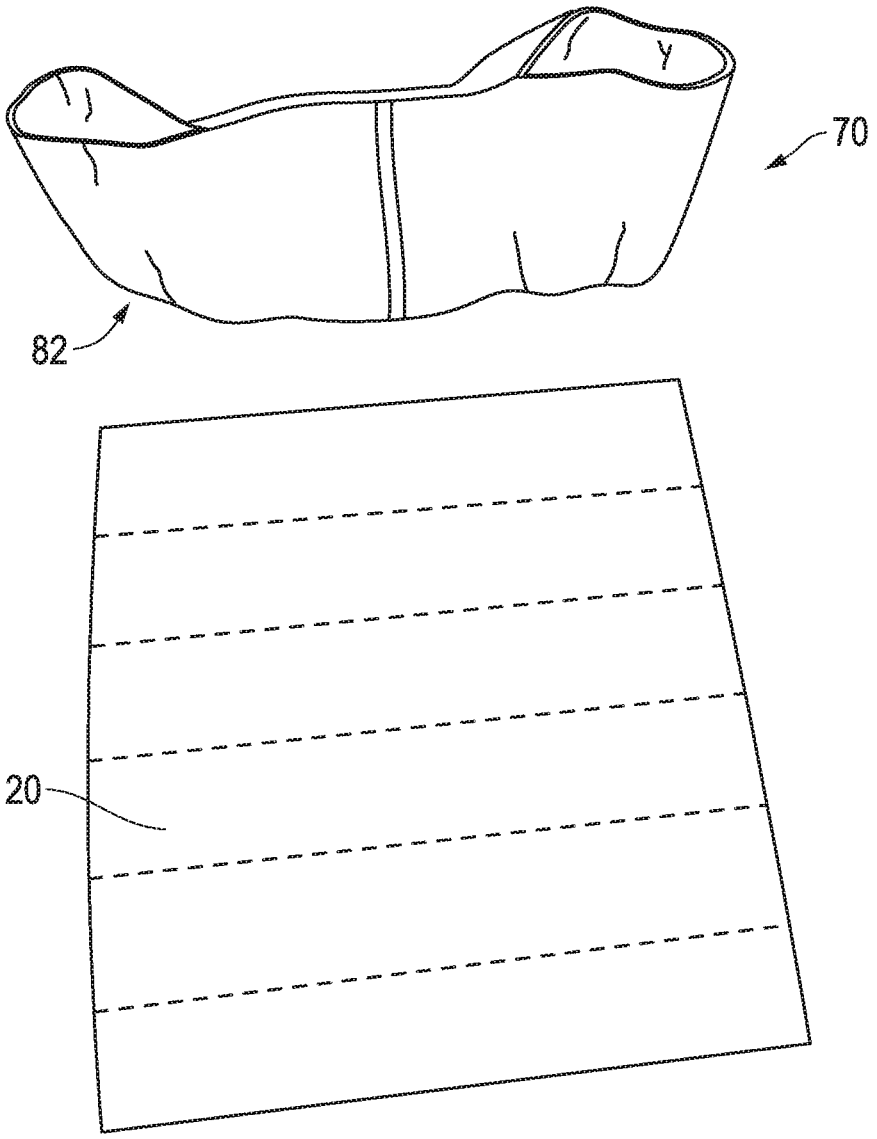
FIG. 14 is a top view of the support band separated from the bib section.

FIG. 11 is a top view of a support band 70 in another embodiment of the present invention. The support band 70 is preferably constructed of a strongly elastic material, such as used for wrapping or support joints (e.g., knees, elbows). FIG. 12 is a top view of the support band 70 attached at a seam 72. Portions of the band are attached together at a portion of the seam. Preferably, the seam is created by sewing one side of the band to another opposite side of the band. In one embodiment, the seam is located at an edge of the band. FIG. 13 is a bottom view of the support band 70 of FIG. 12 with the seam 72. In one embodiment, the band is sewn together at the seam 72 on one edge 74 of the band 70 leaving openings 76 and 78 where the arms of the user are positioned through. The chest of the user is positioned adjacent a frontal portion 80 of the support band, located between the openings 76 and 78 at the seam 72. FIG. 14 is a top view of the support band separated from the bib section 22. If desired, the bib section 20 may be affixed to a lower border 82 of the support band 70. In this embodiment, the support band 70 functions in a similar manner as the support garment 10, without the use of the upper arm sleeves. The openings force or bias the arms of the user positioned within the opening inwardly.

The present invention may be configured with just the support garment, with the bib section, or in the shirt configuration as desired by the user. With use of the support garment, the user may place an additional shirt or other support garment over the support garment.

The present invention may be utilized for various situations, ranging from competitive weight events, rehabilitation where it is desired to reduce stress to the shoulders or any resistance training. The present invention is easy to put on or remove without the help of others. Because of the unique configuration of the upper arm sleeves, the support to the arms and shoulder enable unmatched support compared to existing devices.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

What is claimed is:

1. A support garment for use during resistance training, the support garment comprising:

an elastic frontal portion, wherein the frontal portion extends outward from a user;

a first upper arm sleeve located on a first side of the elastic frontal portion and a second upper arm sleeve located on a second side opposite of the first side of the elastic frontal portion, each upper arm sleeve is configured for wear on an upper arm of the user above an elbow of the user;

wherein the user positions one arm in each upper arm sleeve and positions the elastic frontal portion across a chest of the user during resistance training;

wherein the first upper arm sleeve is sized and shaped to completely surround a first arm of the user and the second upper arm sleeve is sized and shaped to completely surround a second arm of the user;

wherein the frontal portion is configured to be extended outward from the user to form an inner space between the frontal portion and a chest of the user when the first and second arms of the user are extended and the frontal portion conforms to the chest of the user when the first and second arms of the user are bent;

wherein the frontal portion is configured to surround and attach at a lower perimeter of the first upper arm sleeve and the second upper arm sleeve and wherein the frontal portion is positioned below the lower perimeter of each of the upper arm sleeves;

wherein the inner space is shaped to extend out from a plane adjacent to the chest of the user;

wherein the entire first and second upper arm sleeves and the elastic frontal portion are biased in a contracted inward position.

2. The support garment according to claim 1 further comprising a bib section extending from a lower border of the support garment.

3. The support garment according to claim 2 wherein the bib section is constructed of an elastic material.

4. The support garment according to claim 2 wherein the bib section is configured to cover a region of a front torso of the user.

5. The support garment according to claim 2 further comprising a rear portion attached to the bib section and support garment.

6. The support garment according to claim 5 wherein the rear portion is a fabric configured for covering a back of the user.

7. The support garment according to claim 5 wherein the rear portion is constructed of a cotton material.

8. A support garment and bib combination for use during resistance training, the support garment comprising:

a support garment comprising:

an elastic frontal portion, wherein the frontal portion extends outward from a user;

a first upper arm sleeve located on a first side of the elastic frontal portion and a second upper arm sleeve located on a second side opposite of the first side of the elastic frontal portion, each upper arm sleeve is configured for wear on an upper arm of the user above an elbow of the user; and a bib section extending from a lower border of the support garment wherein the user positions one arm in each upper arm sleeve and positions the elastic frontal portion across a chest of the user during resistance training;

wherein the first upper arm sleeve is sized and shaped to completely surround a first arm of the user and the second upper arm sleeve is sized and shaped to completely surround a second arm of the user;

wherein the frontal portion is configured to be extended outward from the user to form an inner space between the frontal portion and a chest of the user when the first and second arms of the user are extended and the frontal portion conforms to the chest of the user when the first and second arms of the user are bent;

wherein the frontal portion is configured to surround and attach at a lower perimeter of the first upper arm sleeve and the second upper arm sleeve and wherein the frontal portion is positioned below the lower perimeter of each of the upper arm sleeves;

wherein the inner space is shaped to extend out from a plane adjacent to the chest of the user;

wherein the entire first and second upper arm sleeves and the elastic frontal portion are biased in a contracted inward position.

9. The combination according to claim 8 wherein the elastic frontal portion is configured with a space between the frontal portion and the chest when worn when the arms of the user are extended and conforms against the chest of the user when the arms of the user are bent.

10. The combination according to claim 8 wherein the bib section is constructed of an elastic material.

11. The combination according to claim 8 wherein the bib section is configured to cover a region of a front torso of the user.

12. The combination according to claim 8 further comprising a rear portion attached to the bib section and support garment.

13. The combination according to claim 12 wherein the rear portion is a fabric configured for covering a back of the user.

14. The combination according to claim 13 wherein the rear portion is constructed of a cotton material.

15. A support band for use during resistance training, the support band comprising:

an elastic band;

an elastic frontal portion formed by affixing a portion of the band together, wherein the frontal portion extends outward from a user;

wherein the elastic band is configured with a first opening located on a first side of the frontal portion and a second opening located on a second side opposite of the first side of the elastic frontal portion, each opening being configured to accommodate an upper arm of a user above an elbow of the user;

wherein the user positions one arm in each opening and positions the elastic frontal portion across a chest of the user during resistance training;

wherein the first opening is sized and shaped to completely surround a first arm of the user and the second opening is sized and shaped to completely surround a second arm of the user;

wherein the frontal portion is configured to be extended outward from the user to form an inner space between the frontal portion and a chest of the user when the first and second arms of the user are extended and the frontal portion conforms to the chest of the user when the first and second arms of the user are bent;

wherein the frontal portion is configured to surround and attach at a lower perimeter of the first and second openings and wherein the frontal portion is positioned below the lower perimeter of each of the openings;

wherein the inner space is shaped to extend out from a plane adjacent to the chest of the user;

wherein the entire first and second openings and the elastic frontal portion are biased in a contracted inward position.

16. The support band according to claim 15 further comprising a bib section extending from a lower border of the support band.

* * * * *